US009779697B2

(12) United States Patent
Lin et al.

(10) Patent No.: US 9,779,697 B2
(45) Date of Patent: Oct. 3, 2017

(54) DISPLAY APPARATUS AND COMPUTER SYSTEM

(71) Applicant: Sitronix Technology Corp., Hsinchu County (TW)

(72) Inventors: Chih-Hsiung Lin, Hsinchu County (TW); Yung-Sheng Tseng, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 113 days.

(21) Appl. No.: 14/810,469

(22) Filed: Jul. 27, 2015

(65) Prior Publication Data

US 2016/0307544 A1 Oct. 20, 2016

(30) Foreign Application Priority Data

Apr. 17, 2015 (TW) ..... 104112444 A

(51) Int. Cl.

*G09G 5/36* (2006.01)
*G09G 3/20* (2006.01)
*G09G 5/373* (2006.01)

(52) U.S. Cl.

CPC ..... *G09G 5/363* (2013.01); *G09G 3/20* (2013.01); *G09G 5/373* (2013.01); *G09G 2330/08* (2013.01); *G09G 2340/0414* (2013.01); *G09G 2340/0421* (2013.01); *G09G 2380/10* (2013.01)

(58) Field of Classification Search

CPC ..... G09G 3/22; G09G 3/3208; G09G 3/30; G09G 3/3225; G09G 3/3233; G09G 3/3241; G09G 3/3266; G09G 3/3275; G09G 3/3258

See application file for complete search history.

(56) References Cited

U.S. PATENT DOCUMENTS 7,362,249 B2 * 4/2008 Kim ..... G09G 3/20 341/135
8,525,822 B2 * 9/2013 Liu ..... G09G 3/3688 345/211
8,681,142 B2 * 3/2014 Bo-Yong ..... G09G 5/00 345/100
9,086,838 B2 * 7/2015 Panvelwala ..... G06F 3/1446
2002/0075204 A1 * 6/2002 Nakano ..... G09G 3/20 345/55
2002/0158859 A1 * 10/2002 Nakano ..... G09G 3/20 345/204
2003/0058202 A1 * 3/2003 Evanicky ..... G09G 3/006 345/82
2005/0179675 A1 * 8/2005 Hekstra ..... G09G 3/2003 345/204

(Continued)

*Primary Examiner* — Kent Chang
*Assistant Examiner* — William Lu
(74) *Attorney, Agent, or Firm* — Winston Hsu

(57) ABSTRACT

A display apparatus for displaying a display information includes a display panel, and a plurality of gate drivers and a plurality of source drivers coupled to the display panel. When one abnormal driver exists among the plurality of gate drivers and the plurality of source drivers, the other functionally operating gate drivers and source drivers transform the display information into a transformed display information to transmit the transformed display information to the display panel for a display operation.

14 Claims, 14 Drawing Sheets

(56) References Cited

U.S. PATENT DOCUMENTS

| | | | | |
|---|---|---|---|---|
| 2006/0044249 | A1* | 3/2006 | Lee | G09G 3/3611 345/98 |
| 2006/0120202 | A1* | 6/2006 | Kim | G09G 3/20 365/230.06 |
| 2007/0030276 | A1* | 2/2007 | MacInnis | G06T 9/007 345/505 |
| 2007/0120772 | A1* | 5/2007 | Kim | G09F 9/35 345/63 |
| 2007/0239921 | A1* | 10/2007 | Toorians | G06F 1/1616 710/306 |
| 2013/0050159 | A1* | 2/2013 | Wang | G09G 3/20 345/204 |
| 2014/0085279 | A1* | 3/2014 | Shiomi | G09G 3/2074 345/204 |
| 2014/0300654 | A1* | 10/2014 | Kim | G09G 5/008 345/691 |
| 2015/0325164 | A1* | 11/2015 | Kim | G09G 3/3607 345/694 |
| 2015/0339967 | A1* | 11/2015 | Shin | G06F 3/1446 345/690 |
| 2016/0118013 | A1* | 4/2016 | Lin | G09G 3/3696 345/212 |

* cited by examiner

70

90

94

DISPLAY APPARATUS AND COMPUTER SYSTEM

BACKGROUND OF THE INVENTION

1. Field of the Invention

The present disclosure relates to a display apparatus and a computer system, and more particularly, to a display apparatus and a computer system which can adaptively adjust a display arrangement of a display information.

2. Description of the Prior Art

For general vehicles, a display apparatus of the vehicles can be classified into many display zones to provide some important and timely information during the driving, such as the current speed rate, the remaining of the gas, or related information representing any malfunction electronic elements/units inside the vehicles. Since the life span of the electronic elements/units cannot be accurately anticipated, the related electronic elements/units of the display apparatus will not be replaced or repaired until the malfunction happens to the display apparatus. Besides, a plurality of source drivers and a plurality of gate drivers of the display apparatus are serially connected. Once a specific source driver or a specific gate driver is broken down, the display apparatus might fail to display an entire display picture, as shown in FIG. 1A. For example, the abnormal display picture may be an erroneous display picture having one area filled with a black band, as shown in FIG. 1B, or another erroneous display picture embedded with a noise band, as shown in FIG. 1C. Under such circumstances, the abnormal display pictures shown in FIG. 1B and FIG. 1C may not be able to display or render related information about the vehicles, such that the driver could distract from the driving because of the abnormal display information and have potential dangers during the driving.

Therefore, it has become an important issue to provide a display apparatus and a computer system which can adaptively adjust a display arrangement of a display information to avoid the occurrence of the abnormal display picture.

SUMMARY OF THE INVENTION

It is therefore an objective of the disclosure to provide a display apparatus and a computer system which can adaptively adjust a display arrangement of a display information to avoid the occurrence of the abnormal display picture.

An embodiment of the disclosure discloses a display apparatus for displaying a display information comprising. The display apparatus comprises a display panel; and a plurality of gate drivers and a plurality of source drivers coupled to the display panel; wherein when one abnormal driver exists among the plurality of gate drivers and the plurality of source drivers, the other functionally operating gate drivers and source drivers transform the display information into a transformed display information, to transmit the transformed display information to the display panel for a display operation.

An embodiment of the disclosure also discloses a computer system, coupled to a display apparatus for displaying a display information. The display apparatus comprises a display panel, a plurality of gate drivers and a plurality of source drivers. The computer system comprises a processing unit; and a storage device, coupled to the processing unit and storing a program code for processing a display method. The display method comprises when one abnormal driver exists among the plurality of gate drivers and the plurality of source drivers, the other functionally operating gate drivers and source drivers transform the display information into a transformed display information, to transmit the transformed display information to the display panel for a display operation.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims, which refer to particular components. As one skilled in the art will appreciate, electronic equipment manufacturers may refer to a component by different names. This document does not intend to distinguish between components that differ in name but not in sub-module. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 2:
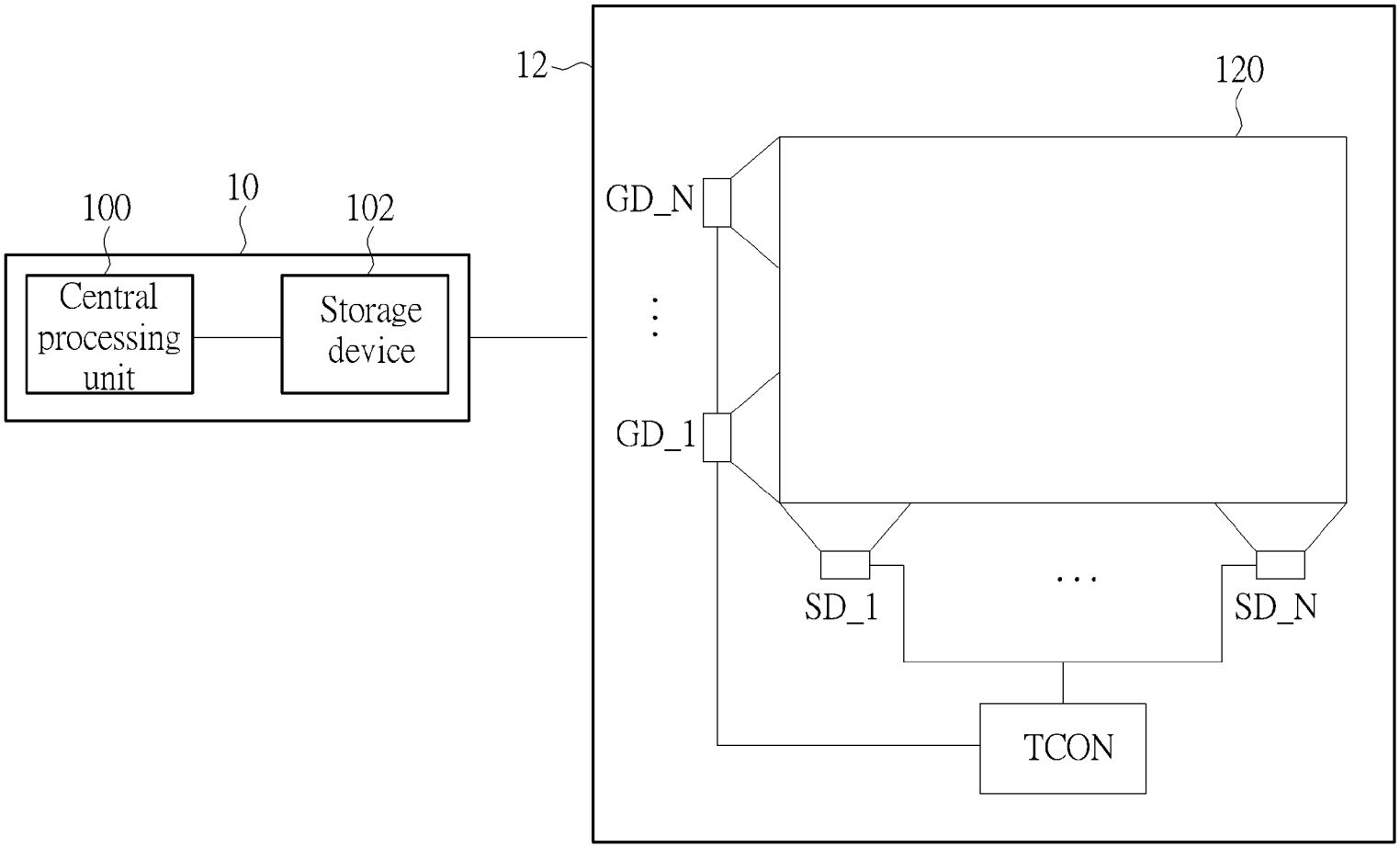
FIG. 2 illustrates a schematic diagram of a computer system coupled to a display apparatus according to an embodiment of the invention.

Please refer to FIG. 2, which illustrates a schematic diagram of a computer system 10 coupled to a display apparatus 12 according to an embodiment of the disclosure. As shown in FIG. 2, the computer system 10 of the embodiment has a basic structure comprising a main board, a processing unit, a memory, a hard disk, a south-bridge module, a north-bridge module, and etc., and should be well known to those skilled in the art. For the brevity, FIG. 2 of the invention only illustrates a processing unit 100 and a storage device 102 of the computer system 10. The storage device 102 can be, but not limited to, read-only memory (ROM), random-access memory (RAM), flash, floppy disk, hardware disk, compact disc, USB flash drive, tape, database accessed via the Internet, or other types of storage medium known to those skilled in the art, to store a program code, such that the processing unit 100 can process the programming code to operate a display method for the display apparatus 12. The display apparatus 12 comprises a display panel 120, a plurality of gate drivers GD_1-GD_N, a plurality of source drivers SD_1-SD_N and a timing controller TCON. The display panel 120 simultaneously connects to the plurality of gate drivers GD_1-GD_N and the plurality of source drivers SD_1-SD_N, and the timing controller TCON also connects to the plurality of gate drivers GD_1-GD_N and the plurality of source drivers SD_1-SD_N, such that a clock signal of the timing controller TCON is utilized to control the plurality of gate drivers GD_1-GD_N and the plurality of source drivers SD_1-SD_N for driving a plurality of display units of the display panel 120, so as to make the display panel 120 display a display information. Also, the embodiment of the invention is not limiting the source of the display information. For example, the display information may come from an image processing unit of the computer system 10, a multimedia source or a digital setup box providing multimedia information, which is also within the scope of the invention.

Figure 3:
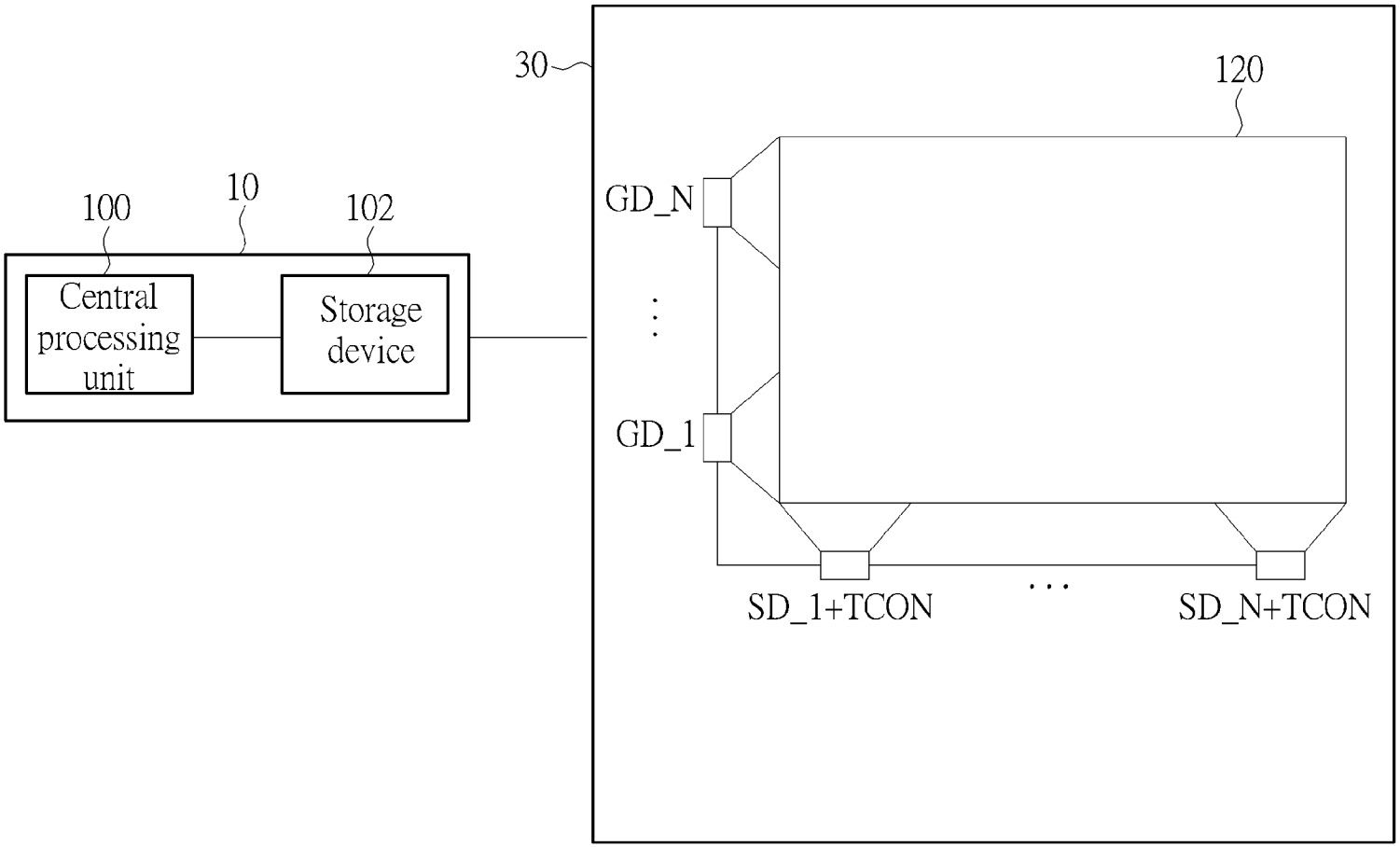
FIG. 3 illustrates a schematic diagram of a computer system coupled to another display apparatus according to an embodiment of the invention.

Please refer to FIG. 3, which illustrates a schematic diagram of the computer system 10 coupled to another display apparatus 30 according to an embodiment of the invention. In comparison, the source drivers SD_1-SD_N and the timing controller TCON of the display apparatus 12 are independently configured to be electrically connected and the timing controller TCON individually transmits the clock signal to the gate drivers GD_1-GD_N and the source drivers SD_1-SD_N; each source driver of the display apparatus 30 in FIG. 3 integrates the timing controller to be SD_1+TCON-SD_N+TCON. Accordingly, the source drivers SD_1+TCON-SD_N+TCON of the display apparatus 30 can sequentially initiate its display operation, and the source driver SD_1+TCON can also generate the clock signal to control the gate drivers GD_1-GD_N for related displaying operations, which is also within the scope of the invention.

Under such circumstances, all the source drivers and the gate drivers of the display apparatus 12 in FIG. 2 or all the source drivers and the gate drivers of the display apparatus 30 in FIG. 3 are electrically connected, and different designs of the timing controller are applied to correspondingly turn on or turn off the source drivers and the gate drivers, so as to receive the display information from an image processing unit (e.g. an image processing unit of the computer system 10, the multimedia source or the digital setup box), such that the display panel 120 can adaptively display the display information. Besides, each of the source drivers SD_1-SD_N and the gate drivers GD_1-GD_N of the embodiment has an image scaling unit, which can adaptively transform the display information into a transformed display information to provide different ratios or sizes of the display information for a display operation. Certainly, the embodiment of the invention is not limiting the connection relationship of the computer system 10, the display apparatuses 12, 30 and the image processing unit, and those skilled in the art can correspondingly utilize a wired transmission or a wireless transmission to transmit the display information according to the transmission amounts of the display information. For convenience, the following embodiment of the invention demonstrates the case that the computer system 10 is coupled to the display apparatus 12 and the image processing unit is integrated inside the computer system 10, which is not limiting the scope of the invention.

Figure 4A:
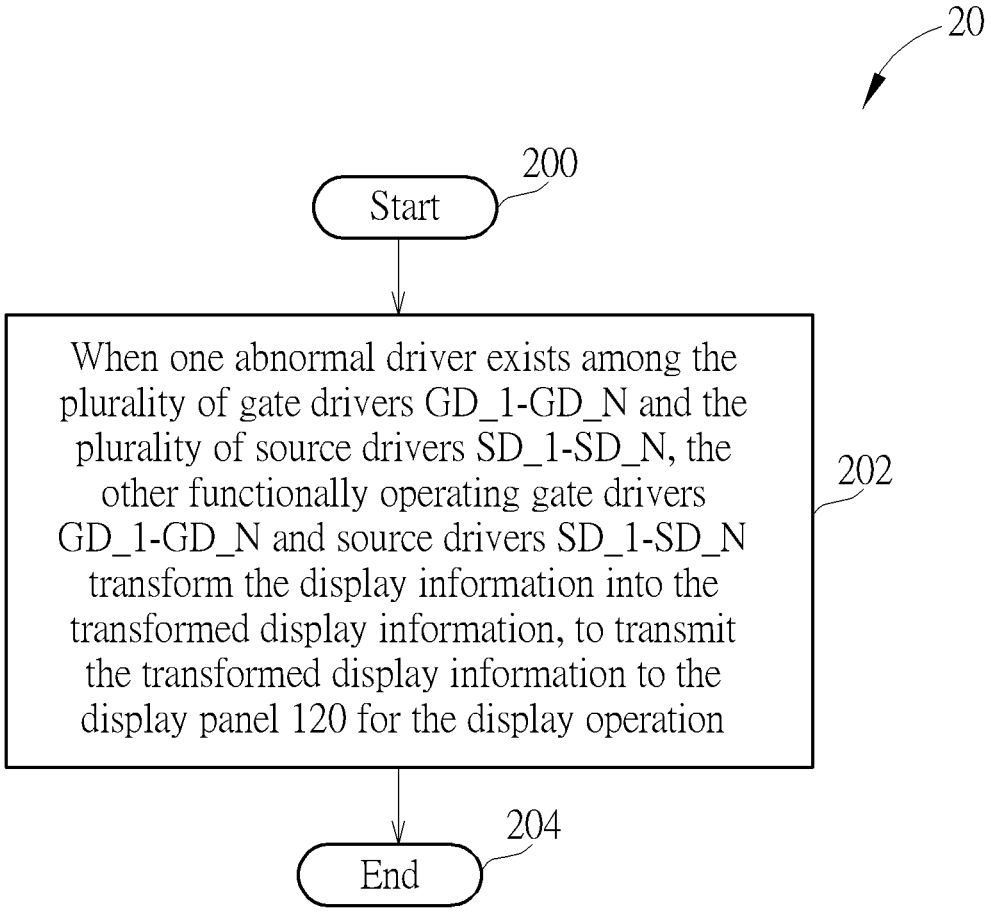
FIG. 4A and FIG. 4B illustrate flow charts of display processes according to embodiments of the invention.

In one embodiment, a display method for the display apparatus 12 can be summarized as a display process 20 to be compiled as a programming code stored inside the storage device 102, as shown in FIG. 4A. In another embodiment, the programming code corresponding to the display process 20 can also be stored in a storage unit of the display apparatus 12, and a processing unit of the display apparatus 12 is operated to process the programming code, i.e. the display apparatus 12 can independently process the display method without being connected with the computer system 10, which is also within the scope of the invention.

Further, the display process 20 of the embodiment includes the steps as follows.

Step 200: Start.

Step 202: When one abnormal driver exists among the plurality of gate drivers GD_1-GD_N and the plurality of source drivers SD_1-SD_N, the other functionally operating gate drivers GD_1-GD_N and source drivers SD_1-SD_N transform the display information into the transformed display information, to transmit the transformed display information to the display panel 120 for the display operation.

Step 204: End.

In the embodiment, the display process 20 is operated to prevent the abnormal driver(s) among the plurality of gate drivers GD_1-GD_N and the plurality of source drivers SD_1-SD_N from displaying the display information, so as to make the other functionally operating gate drivers GD_1-GD_N and source drivers SD_1-SD_N display the display information. Besides, the size of the display information can be adaptively magnified or minified to adjust a display arrangement of the display information, so as to comply with the operational status of the gate drivers GD_1-GD_N and the source drivers SD_1-SD_N.

Figure 4B:
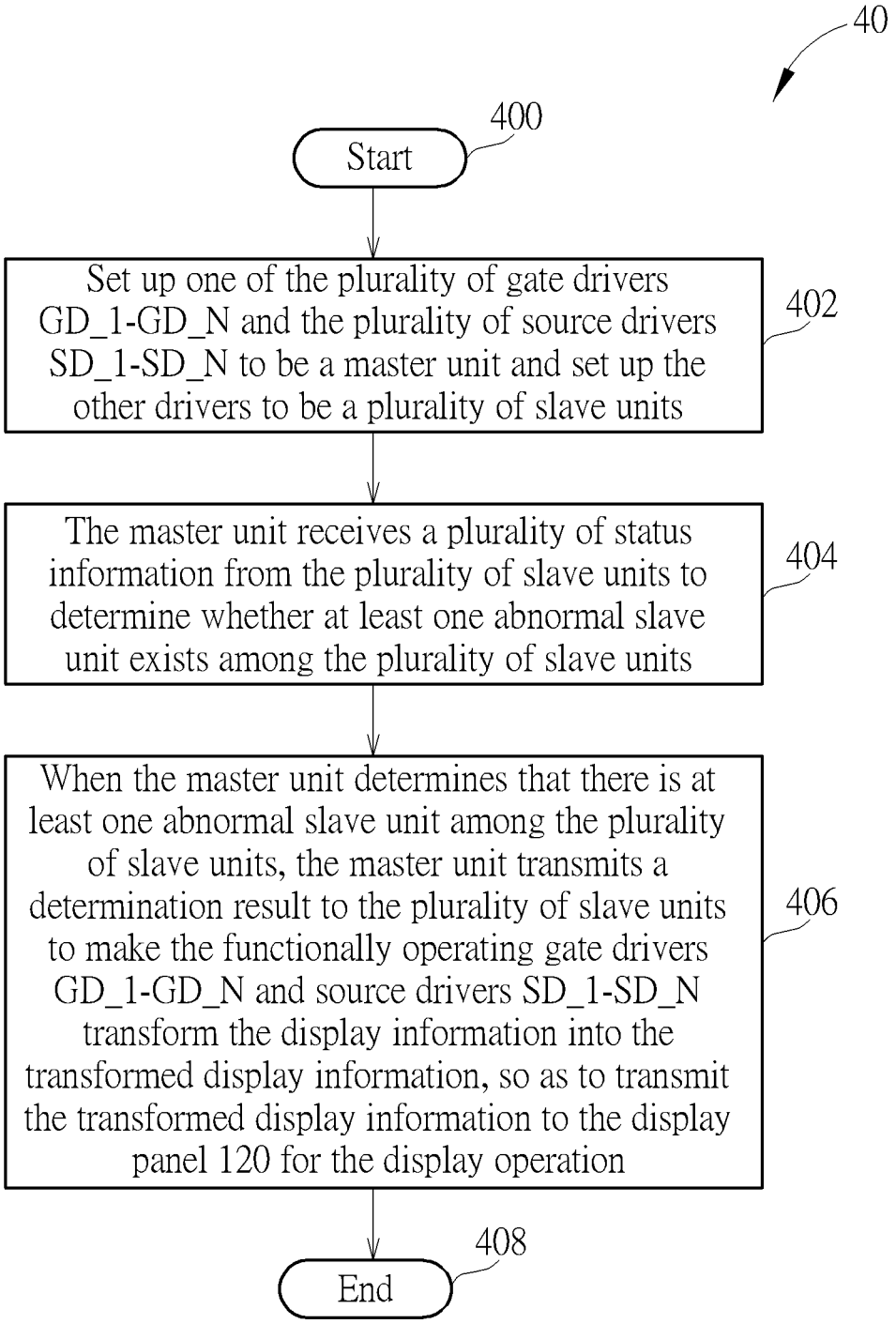

Additionally, another display method for the display apparatus 12 can be summarized as a display process 40 to be compiled as a programming code stored inside the storage device 102, as shown in FIG. 4B. In another embodiment, the programming code corresponding to the display process 40 can also be stored in the storage unit of the display apparatus 12, and the processing unit of the display apparatus 12 is operated to process the programming code, i.e. the display apparatus 12 can independently process the display method without being connected with the computer system 10, which is also within the scope of the invention.

Further, the display process 40 of the embodiment includes the steps as follows.

Step 400: Start.

Step 402: Set up one of the plurality of gate drivers GD_1-GD_N and the plurality of source drivers SD_1-SD_N to be a master unit and set up the other drivers to be a plurality of slave units.

Step 404: The master unit receives a plurality of status information from the plurality of slave units to determine whether at least one abnormal slave unit exists among the plurality of slave units.

Step 406: When the master unit determines that there is at least one abnormal slave unit among the plurality of slave units, the master unit transmits a determination result to the plurality of slave units to make the functionally operating gate drivers GD_1-GD_N and source drivers SD_1-SD_N transform the display information into the transformed display information, so as to transmit the transformed display information to the display panel 120 for the display operation.

Step 408: End.

In comparison with the display process 20, the display process 40 of the embodiment further sets up the plurality of gate/source drivers to be the master unit and the slave unit, so as to establish the two-way transmission operation among the plurality of drivers. Specifically, a user can adaptively choose one of the plurality of drivers to be the master unit, or an original setting value can be predetermined for determining the master unit after the production. Also, an additional software/hardware interface may be adaptively provided to have the user determine the setting value on his (her) own, which is not limiting the scope of the invention.

Accordingly, in step 402, the display apparatus 12 of the embodiment will set up one of the plurality of gate drivers GD_1-GD_N and the plurality of source drivers SD_1-SD_N to be the master unit and set up the other drivers to be the plurality of slave units. Preferably, since all of the gate drivers GD_1-GD_N and the source drivers SD_1-SD_N are electrically connected, the gate driver or the source driver being set up as the master unit can correspondingly control operations of the other drivers and the two-way transmission operation can be correspondingly formed among the master unit and the slave units.

In step 404, the master unit receives the plurality of status information from the slave units to determine whether at least one abnormal slave unit exists among the slave units. Preferably, the master unit of the embodiment can individually receive the status information from each of the slave units, and can determine the operational status of each the slave unit according to the status information. In the embodiment, the master unit and the slave units can utilize a coding way for packet transmission, such as the Inter-Integrated Circuit (I2C). Accordingly, the slave units being disposed at different positions with different operations (i.e. they are the gate driver or the source driver of the display panel 120 being utilized to trigger different display units of different zones) can correspondingly transmit a transmission packet including different instruction information to the master unit, such that the master unit can determine whether at least one abnormal slave unit exists among the plurality of slave units.

For example, the embodiment of the invention can set up the source driver at the first column to be the master unit. Under such circumstances, since the two-way transmission operation among the plurality of source drivers and the plurality of gate drivers has been established, the master unit can sequentially receive the plurality of transmission packets from the source drivers at the second row to the Nth row and from the gate drivers at the first column to the Nth column. Preferably, each transmission packet includes its position information and the instruction information corresponding to different operational status, such that the master unit can clearly know how many the slave units are abnormal with the related position information. For instance, the source driver at the second column can transmit the transmission packet including the instruction information as 01h and 010b to the master unit, and the master unit can determine that the source driver at the second column is functionally operated. Or the source driver at the second column can transmit the transmission packet including the instruction information as 02h and 010b to the master unit, and the master unit can determine that the source driver at the second column is broken down. After the master unit receives all the transmission packets from the slave units in a transmission period, the master unit can adaptively monitor/determine the operational statuses of all the slave units and related information associated with the number and the position of the abnormal driver(s) can be correspondingly recorded. Certainly, the instruction information and the transmission of the transmission packet hereinafter are demonstrated as one example, which is not limiting the scope of the invention.

In step 406, when at least one abnormal slave unit exists among the plurality of slave units, the master unit of the embodiment can transmit the determination result to the plurality of slave units, to make the functionally operating gate drivers GD_1-GD_N and source drivers SD_1-SD_N transform the display information into the transformed display information, so as to transmit the transformed display information to the display panel 120 for the display operation. In other words, once the master unit has determined the number and the position of the abnormal drivers, the related information of the abnormal drivers will be transmitted to all the source drivers and the gate drivers, i.e. the determination result of the embodiment includes all the related information about the number and the position of the abnormal drivers, such that the functionally operating source drivers and gate drivers inside the display apparatus 12 can cooperate to process the display operation for the display information. Under such circumstances, the embodiment of the invention can prevent the abnormal source/gate driver(s) from continuously displaying the display information, and the neighboring drivers of the abnormal source/gate driver(s) will take the responsibility for the abnormal source/gate driver(s) to continuously process the display operation. In the meanwhile, the image scaling unit inside each of the functionally operating drivers can correspondingly process a scaling operation for the original display information, to generate the transformed display information to be transmitted to the display panel 120, so as to avoid the abnormal source/gate driver(s) processing the display operations.

For example, in one embodiment, the master unit of the embodiment can transmit the transmission packet including the instruction information as 00h and 000b to all the slave units, to inform all the slave units that all the source drivers and the gate drivers can be functionally operated. In another embodiment, the master unit of the embodiment can transmit the transmission packet including the instruction information as 08h and 000b to all the slave units, to inform all the slave units that the source driver at the second column is broken down and the other source/gate drivers are functionally operated. Certainly, the instruction information and the transmission of the transmission packet hereinafter are demonstrated as one example, which is not limiting the scope of the invention.

Preferably, in the embodiment, if the master unit of the display apparatus 12 detects that the abnormal slave unit being a gate driver, the functionally operating gate drivers GD_1-GD_N can vertically transform the display information into the transformed display information according to a vertical position of the abnormal slave unit, to make the display panel 120 display the transformed display information. In the meanwhile, the display panel 120 of the embodiment is vertically classified into a display zone and a non-display zone according to the vertical position of the at least one abnormal slave unit, such that the transformed display information is displayed on the display zone and the non-display zone corresponds to the vertical position of the at least one abnormal slave unit.

Furthermore, if the master unit of the display apparatus 12 detects that the abnormal slave unit being a source driver, the functionally operating source drivers SD_1-SD_N can horizontally transform the display information into the transformed display information according to a horizontal position of the abnormal slave unit, to make the display panel 120 display the transformed display information. In the meanwhile, the display panel 120 of the embodiment is horizontally classified into a display zone and a non-display zone according to the horizontal position of the at least one abnormal slave unit, such that the transformed display information is displayed on the display zone and the non-display zone corresponds to the horizontal position of the at least one abnormal slave unit.

Figure 1A:
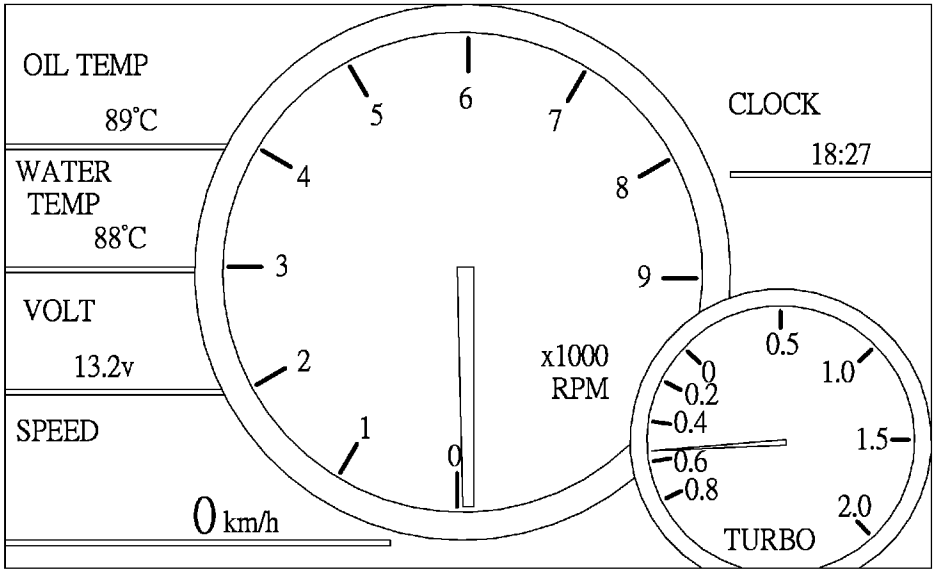
FIG. 1A PRIOR ART
FIG. 1A illustrates a conventional schematic diagram of an entire display picture.
Figure 1B:
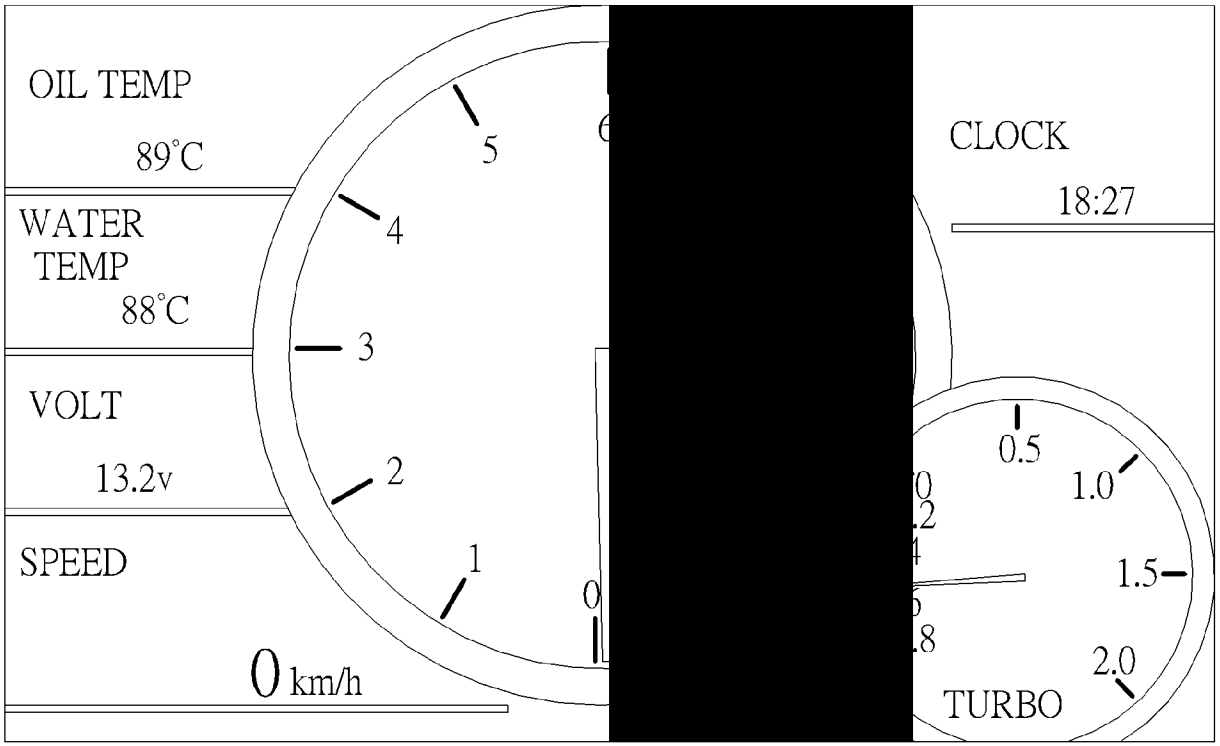
FIG. 1B PRIOR ART
FIG. 1B and FIG. 1C illustrate conventional schematic diagrams of erroneous display pictures.
Figure 1C:
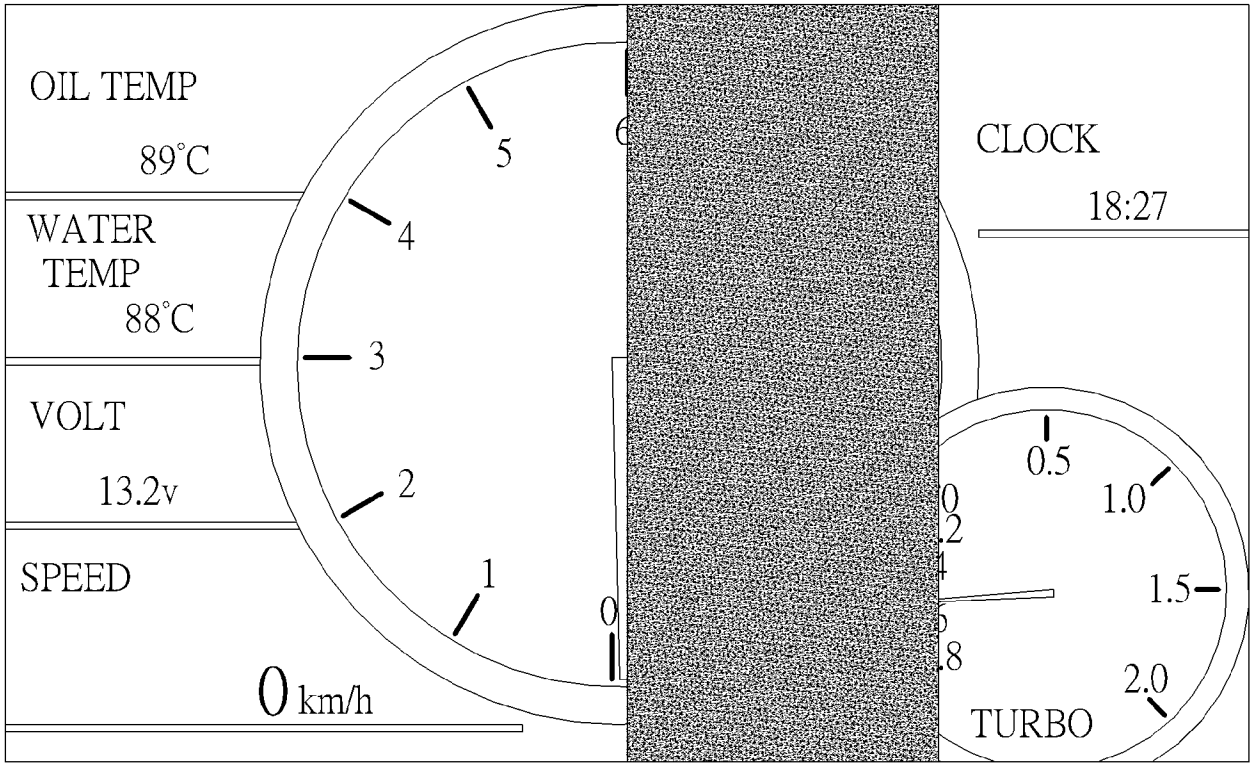
FIG. 1C PRIOR ART

In other words, the image scaling unit of the source driver or the gate driver of the embodiment can adopt an adaptive scaling ratio to transform the display information into the transformed display information according to the horizontal position or vertical position of the abnormal slave unit, to control the functionally operating source drivers and gate drivers for driving related display zones on the display panel 120, so as to display the transformed display information and to prevent the abnormal source/gate driver in the non-display zone from processing the display operation. In comparison with the prior art having the erroneous display pictures shown in FIG. 1B and FIG. 1C, the display apparatus 12 and the display processes 20 and 40 of the embodiment can utilize the two-way transmission operation between the master unit and the plurality of slave units to correspondingly transform the display information into the transformed display information, so as to make the transformed display information be displayed on the functionally operating display zone for preventing the generation of the erroneous display pictures, which may cause the user to misunderstand the current situation or to make an erroneous judgment/decision.

Figure 5:
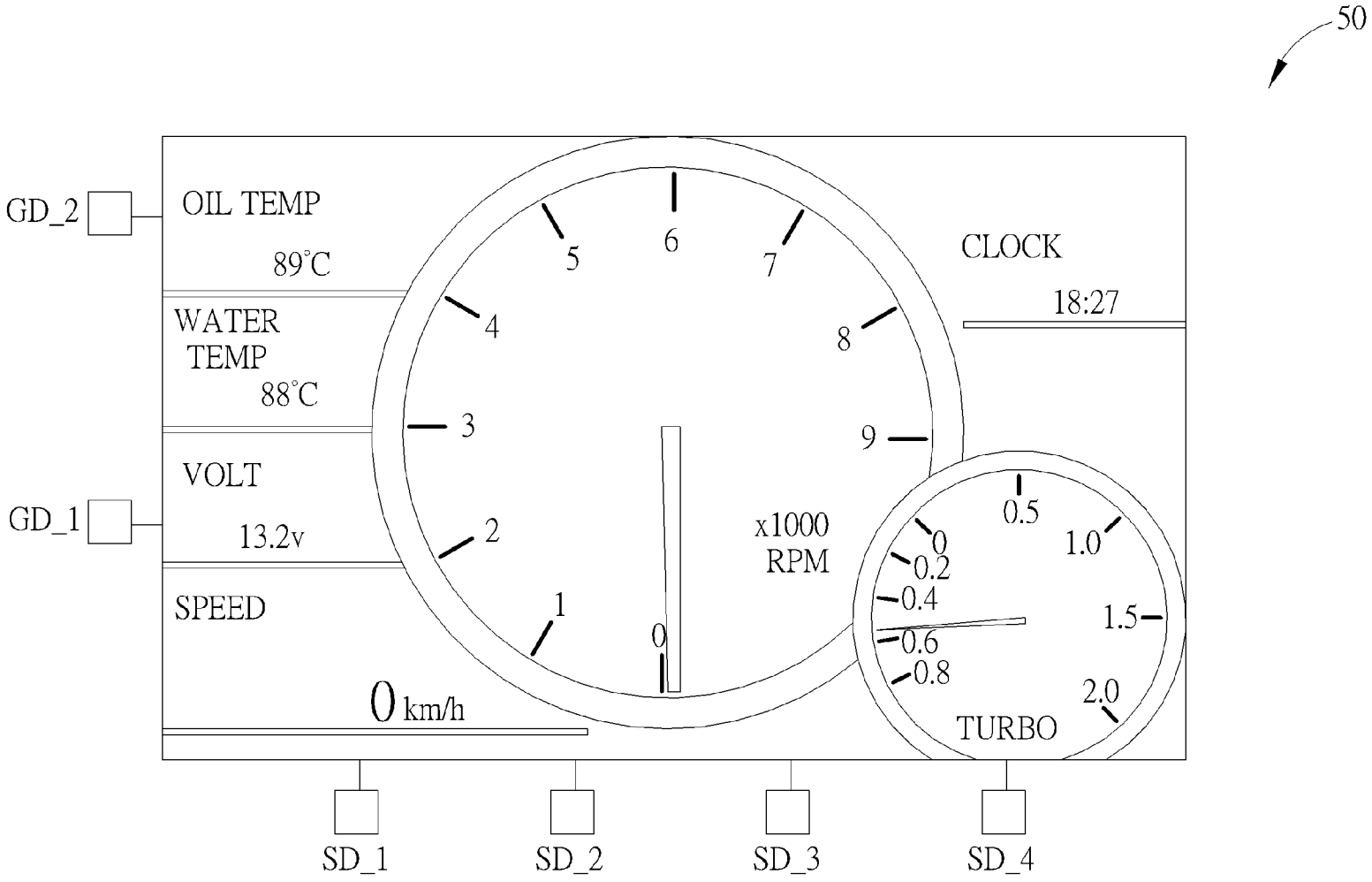
FIG. 5 illustrates a schematic diagram of a display information according to an embodiment of the invention.

Please refer to FIG. 5, which illustrates a schematic diagram of a display information 50 according to an embodiment of the invention. As shown in FIG. 5, the display information 50 of the embodiment can be a vehicle display panel, and there are four source drivers (i.e. the first source driver SD_1, the second source driver SD_2, the third source driver SD_3 and the fourth source driver SD_4) and two gate drivers (i.e. the first gate driver GD_1 and the second gate driver GD_2) to be utilized to show the display information 50. When the master unit of the display apparatus has detected that there is at least one abnormal driver among the source drivers and the gate drivers, the master unit can transmit the status information of the abnormal driver to the other drivers, to instruct the other drivers about the displaying of the transformed display information. Hereinafter, the display arrangement and related operations/mechanisms of different transformed display information will be demonstrated in following paragraphs and FIG. 6 to FIG. 11.

Figure 6:
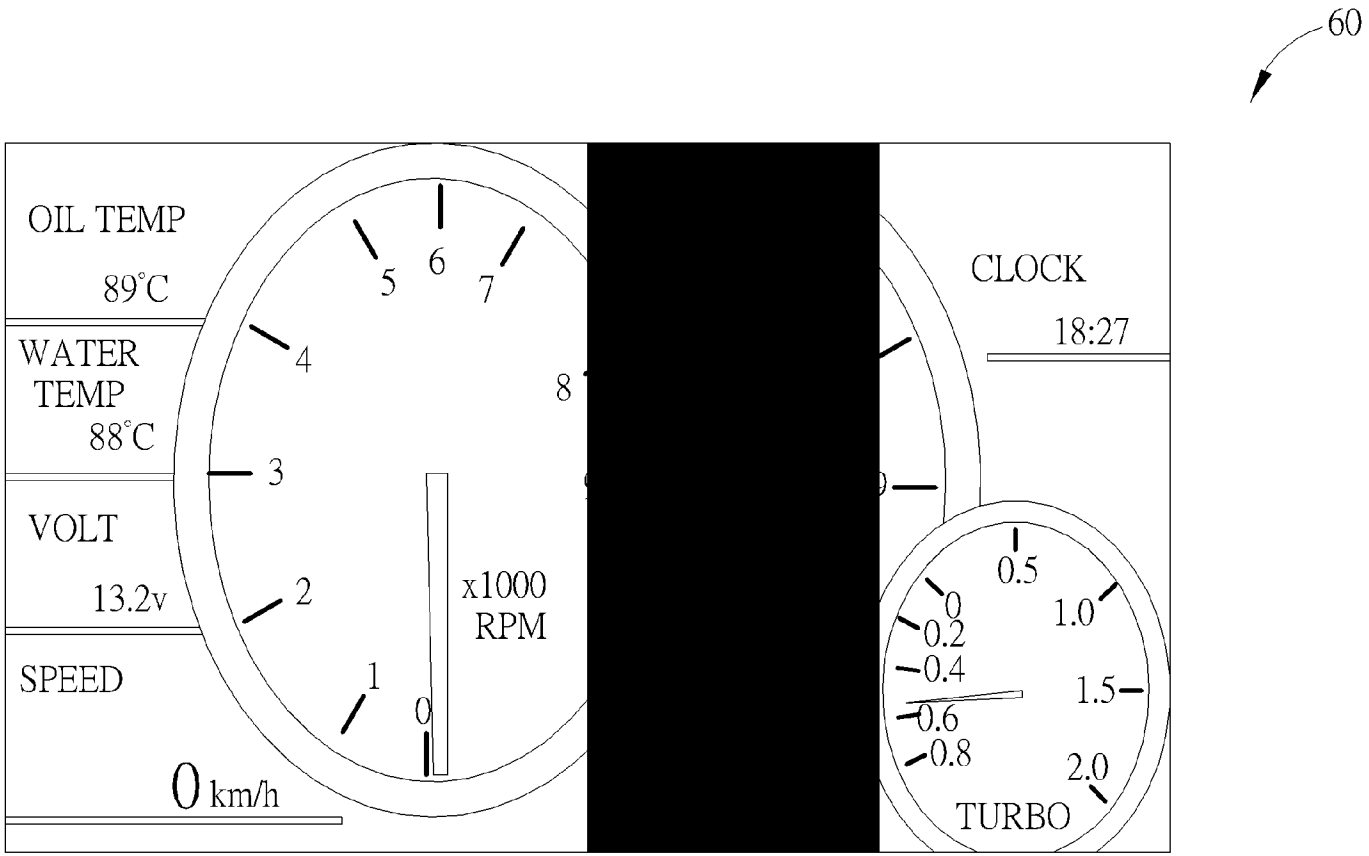
FIG. 6 to FIG. 11 illustrate different transformed display information according to embodiments of the invention.
Figure 7:
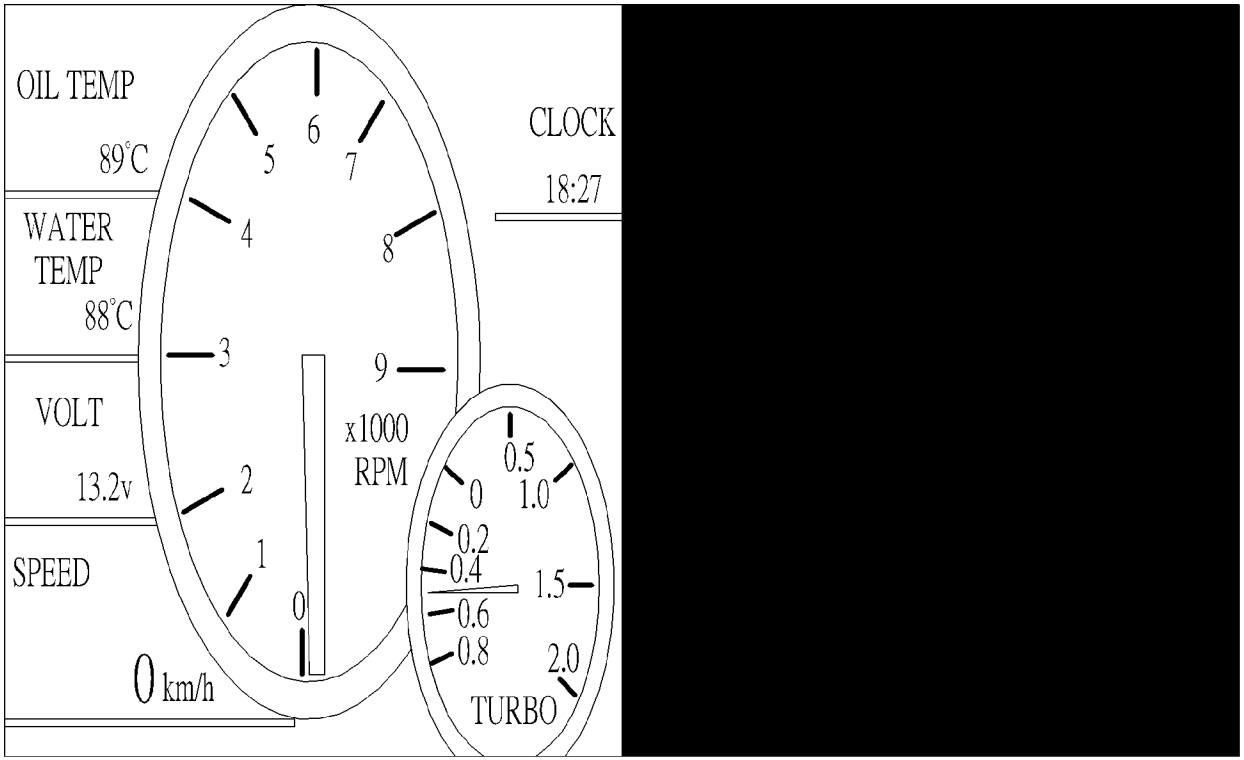
Figure 8:
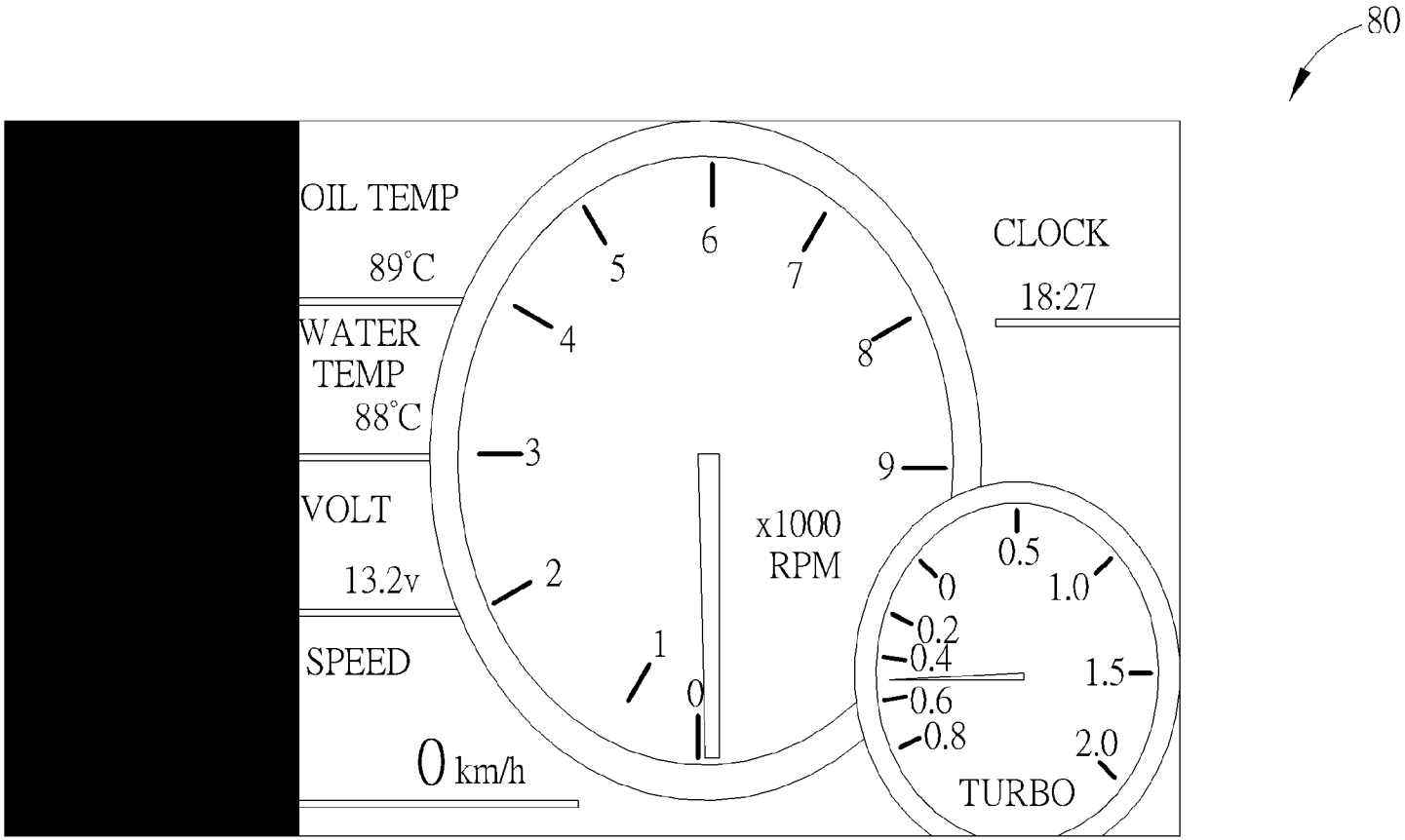
Figure 9:
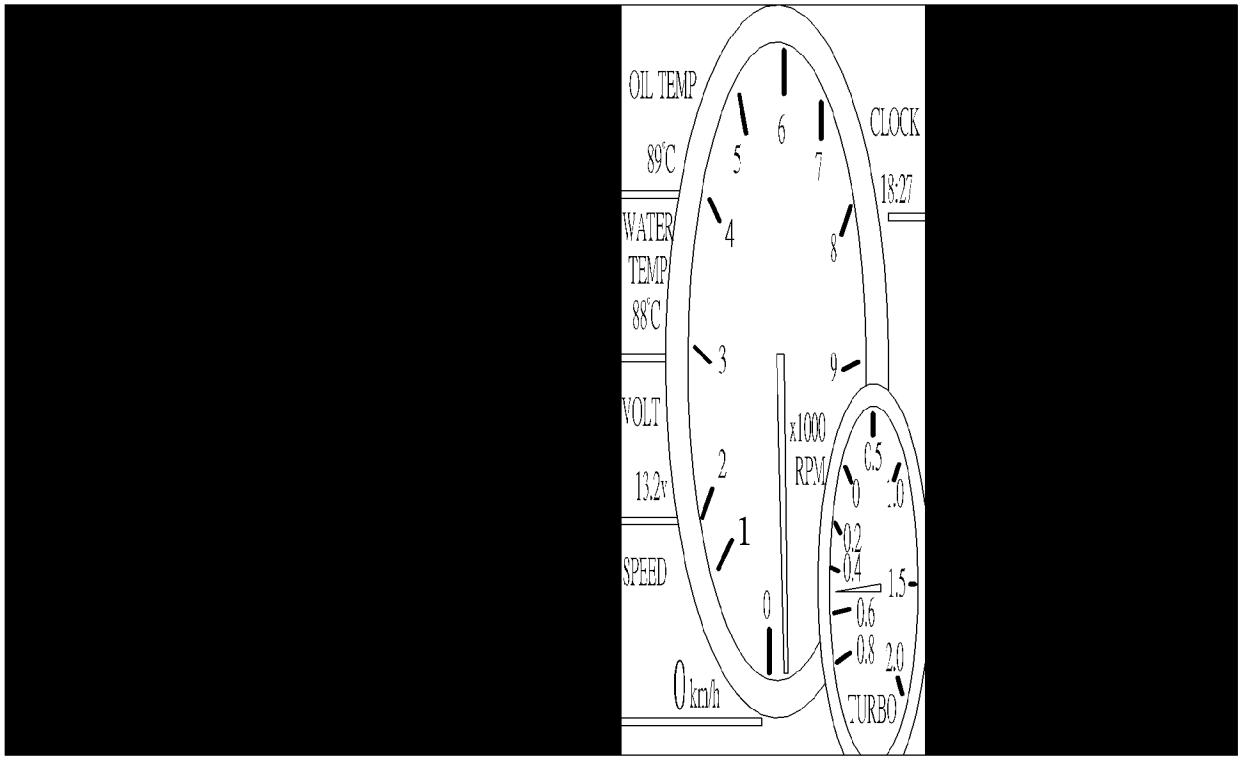

As shown in FIG. 6, when the third source driver SD_3 is the abnormal driver, the source drivers SD_1 and SD_2 can compress apart of the display information 50, i.e. the three fourths of the display information 50 on the left will be compressed with the ratio of two thirds, and the source driver SD_4 is operated to display the original one fourth of the display information 50 on the right, such that a transformed display information 60 is generated and the source drivers SD_1, SD_2 and SD_4 is operated to display the transformed display information 60. As shown in FIG. 7, when the third source driver SD_3 and the fourth source driver SD_4 are the abnormal drivers, the source drivers SD_1 and SD_2 can horizontally compress the display information 50 with the ratio of one half to generate a transformed display information 70, such that the source drivers SD_1 and SD_2 are operated to averagely display the transformed display information 70. For the sake of the best resolution of the display panel, the transformed display information 70 shown in FIG. 7 can also be fitted in the case that only the third source driver SD_3 is the abnormal driver, such that the utilization of the transformed display information 70 can avoid a discontinuous picture of the transformed display information 60 shown in FIG. 6. Please refer to FIG. 8 and FIG. 9, wherein FIG. 8 illustrates a transformed display information 80, which represents that the first source driver SD_1 is the abnormal source driver and the source drivers SD_2, SD_3 and SD_4 are operated to display the transformed display information 80, and FIG. 9 illustrates a transformed display information 90, which represents that many source drivers are broken down, i.e. the first source driver SD_1, the second source driver SD_2 and the fourth source driver SD_4 are the abnormal source drivers and only the third source driver SD_3 is operated to display the transformed display information 90.

Figure 10:
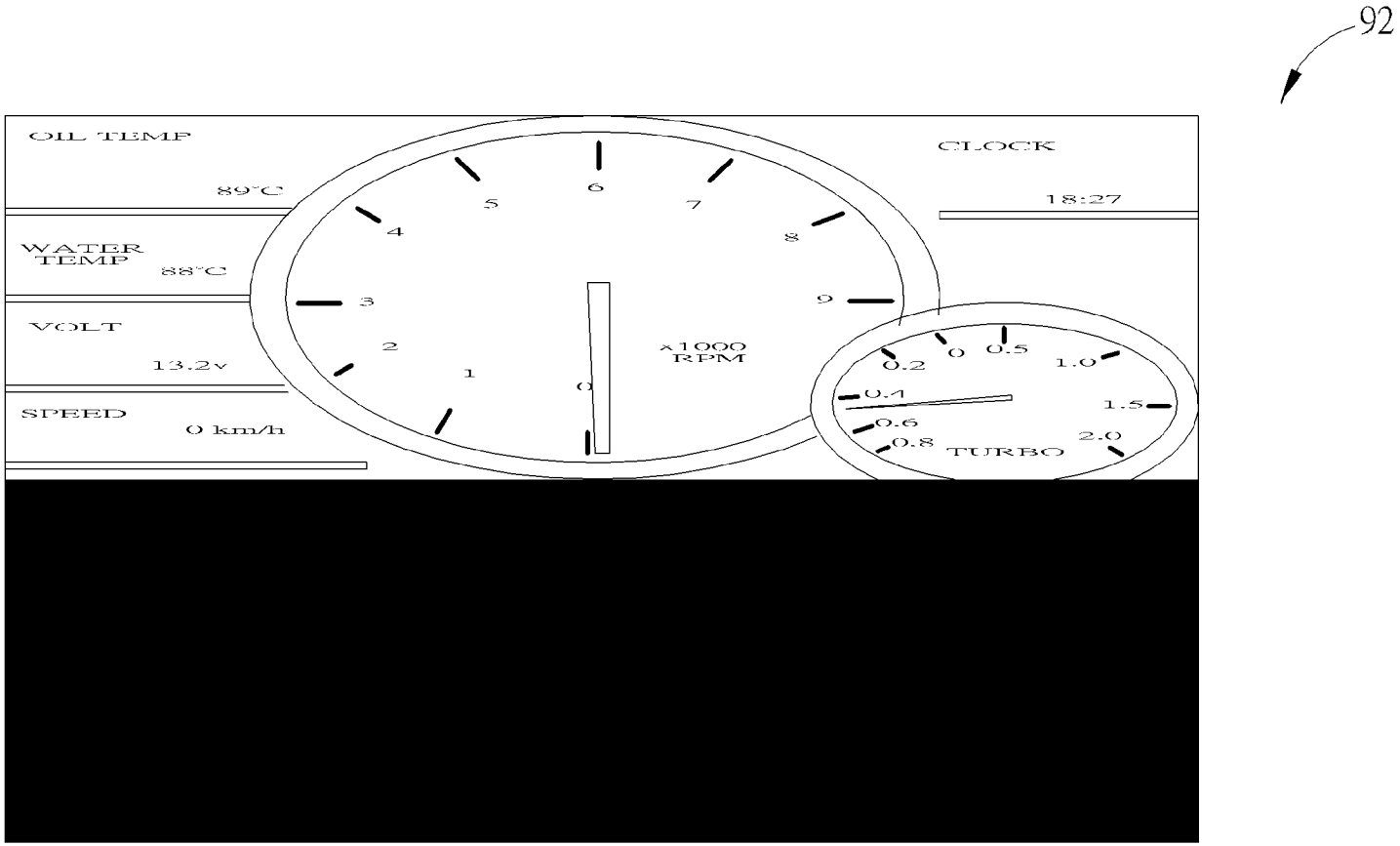
Figure 11:
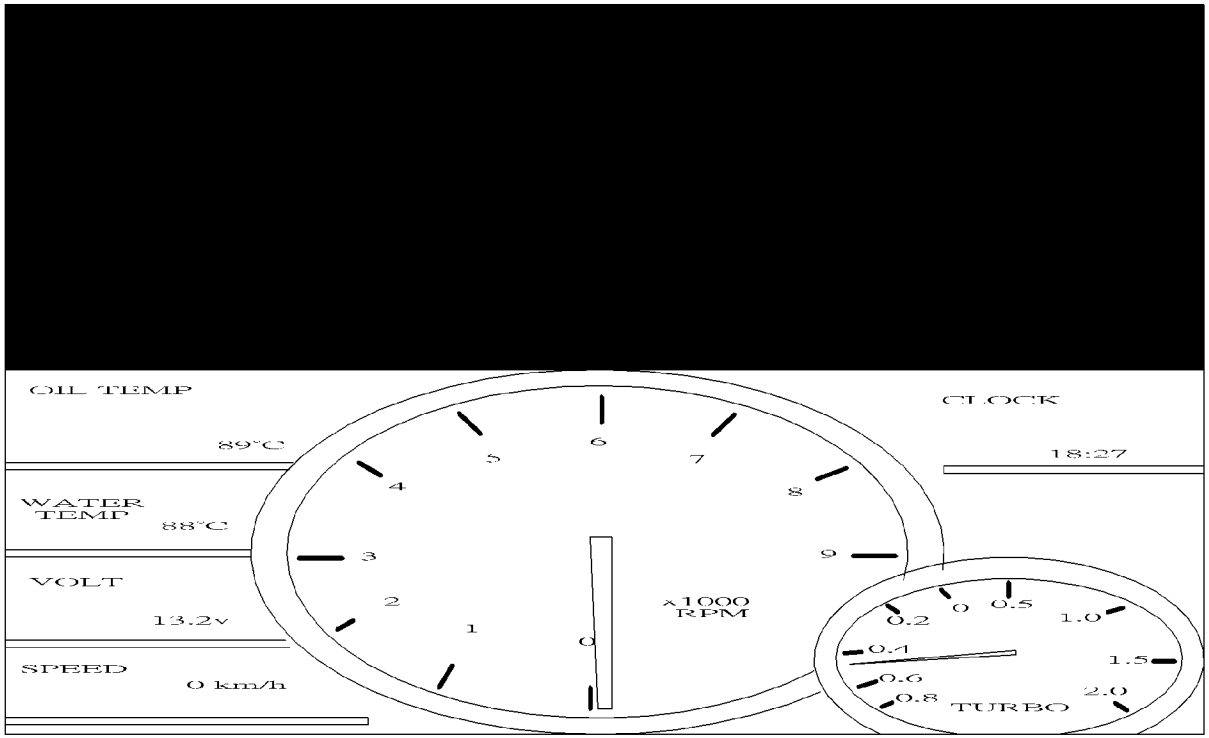

Please refer to FIG. 10 and FIG. 11, wherein FIG. 10 illustrates a transformed display information 92, which represents that the first gate driver GD_1 is the abnormal gate driver and the second gate drivers GD_2 vertically compresses the display information 50 with the ratio of one half and displays the transformed display information 92 at the vertical direction, and FIG. 11 illustrates a transformed display information 94, which represents that the second gate driver GD_2 is the abnormal gate driver and the first gate drivers GD_1 vertically compresses the display information 50 with the ratio of one half and displays the transformed display information 94 at the vertical direction.

Certainly, the transformed display information and the corresponding abnormal driver(s) thereof shown in FIG. 6 to FIG. 11 are demonstrated for illustration, and those skilled in the art can adaptively modify or change the scaling ratio of the transformed display information and the corresponding display arrangement thereof, to deal with different number of the abnormal source/gate drivers or to handle the situation that both the horizontal direction and the vertical direction have at least one abnormal driver, such that the functionally operating drivers neighboring the abnormal driver(s) can utilize the image scaling unit to correspondingly transform the display information into the transformed display information according to the determination result of the master unit without abandoning the best resolution, which is also within the scope of the invention.

In summary, embodiments of the disclosure provide a display apparatus and display method which can adaptively transform the size of the display information. By setting up the plurality of drivers to be a master unit and a plurality of slave units, the two-way transmission operation can be established between the master unit and the slave units, such that the master unit can adaptively detect/monitor whether at least one abnormal unit exists among the slave units and instruct the slave units about how to transform the original display information with different ratio values. In comparison with the prior art which may fail to display the entire display picture if at least one abnormal electronic element/unit exists, the embodiment of the invention can correspondingly transform/compress the original display information with different sizes and ratio values, to prevent the abnormal driver(s) from processing the display operation, so as to display the transformed display information on the display units corresponding to the functionally operating drivers, such that the application range of the display apparatus can be broadened with the additional protection operations/mechanisms.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display apparatus for displaying a display information, the display apparatus comprising:

a display panel; and a plurality of gate drivers and a plurality of source drivers coupled to the display panel;

wherein when one abnormal driver exists among the plurality of gate drivers and the plurality of source drivers, the other functionally operating gate drivers and source drivers transform the display information into a transformed display information, to transmit the transformed display information to the display panel for a display operation;

wherein one of the plurality of gate drivers and the plurality of source drivers is set up as a master unit and the other drivers are set up as a plurality of slave units, such that the master unit receive a plurality of status information from the plurality of slave units to determine whether at least one abnormal slave unit exists among the plurality of slave units, and when the master unit determines there is at least one abnormal slave unit among the plurality of slave units, the master unit transmits a determination result to the plurality of slave units to make the functionally operating gate drivers and source drivers process the display operation.

2. The display apparatus of claim 1, wherein when the at least one abnormal slave unit is a gate driver, the functionally operating gate drivers vertically transform the display information into the transformed display information according to a vertical position of the abnormal slave unit, to make the display panel display the transformed display information.

3. The display apparatus of claim 1, wherein when the at least one abnormal slave unit is a gate driver, the display panel is vertically classified into a display zone and a non-display zone according to a vertical position of the at least one abnormal slave unit, such that the transformed display information is displayed on the display zone and the non-display zone corresponds to the vertical position of the at least one abnormal slave unit.

4. The display apparatus of claim 1, wherein when the at least one abnormal slave unit is a source driver, the functionally operating source drivers horizontally transform the display information into the transformed display information according to a horizontal position of the abnormal slave unit, to make the display panel display the transformed display information.

5. The display apparatus of claim 1, wherein when the at least one abnormal slave unit is a source driver, the display panel is horizontally classified into a display zone and a non-display zone according to a horizontal position of the at least one abnormal slave unit, such that the transformed display information is displayed on the display zone and the non-display zone corresponds to the horizontal position of the at least one abnormal slave unit.

6. The display apparatus of claim 1, wherein each source driver further comprises a timing controller to generate a clock signal for assisting a demonstration of the transformed display information.

7. The display apparatus of claim 1, wherein all of the gate drivers and the source drivers comprise an image scaling unit to transform the display information into the transformed display information according to a scaling ratio.

8. A computer system, coupled to a display apparatus for displaying a display information, wherein the display apparatus comprises a display panel, a plurality of gate drivers and a plurality of source drivers, the computer system comprising:

a processing unit; and a storage device, coupled to the processing unit and storing a program code for processing a display method, the display method comprising:

when one abnormal driver exists among the plurality of gate drivers and the plurality of source drivers, the other functionally operating gate drivers and source drivers transform the display information into a transformed display information, to transmit the transformed display information to the display panel for a display operation;

setting up one of the plurality of gate drivers and the plurality of source drivers to be a master unit and setting up the other drivers to be a plurality of slave units;

the master unit receiving a plurality of status information from the plurality of slave units to determine whether at least one abnormal slave unit exists among the plurality of slave units; and when the master unit determines there is at least one abnormal slave unit among the plurality of slave units, the master unit transmits a determination result to the plurality of slave units to make the functionally operating gate drivers and source drivers process the display operation.

9. The computer system of claim 8, wherein the display method further comprises:

when the at least one abnormal slave unit is a gate driver, the functionally operating gate drivers vertically transform the display information into the transformed display information according to a vertical position of the abnormal slave unit, to make the display panel display the transformed display information.

10. The computer system of claim 8, wherein the display method further comprises:

when the at least one abnormal slave unit is a gate driver, the display panel is vertically classified into a display zone and a non-display zone according to a vertical position of the at least one abnormal slave unit, such that the transformed display information is displayed on the display zone and the non-display zone corresponds to the vertical position of the at least one abnormal slave unit.

11. The computer system of claim 8, wherein the display method further comprises:

when the at least one abnormal slave unit is a source driver, the functionally operating source drivers horizontally transform the display information into the transformed display information according to a horizontal position of the abnormal slave unit, to make the display panel display the transformed display information.

12. The computer system of claim 8, wherein the display method further comprises:

when the at least one abnormal slave unit is a source driver, the display panel is horizontally classified into a display zone and a non-display zone according to a horizontal position of the at least one abnormal slave unit, such that the transformed display information is displayed on the display zone and the non-display zone corresponds to the horizontal position of the at least one abnormal slave unit.

13. The computer system of claim 8, wherein each source driver of the display apparatus further comprises a timing controller to generate a clock signal for assisting a demonstration of the transformed display information.

14. The computer system of claim 8, wherein all of the gate drivers and the source drivers comprise an image scaling unit to transform the display information into the transformed display information according to a scaling ratio.

* * * * *